US007172468B2

(12) United States Patent
Nishide

(10) Patent No.: US 7,172,468 B2
(45) Date of Patent: Feb. 6, 2007

(54) DIVIDED CONNECTOR AND METHOD OF ASSEMBLING IT

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/318,708

(22) Filed: Dec. 27, 2005

(65) Prior Publication Data

US 2006/0141850 A1 Jun. 29, 2006

(30) Foreign Application Priority Data

Dec. 28, 2004 (JP) ..... 2004-378838

(51) Int. Cl.
*H01R 13/502* (2006.01)

(52) U.S. Cl. ..... 439/701; 439/368; 439/902; 439/468

(58) Field of Classification Search ..... 439/368, 439/345, 701, 902, 157, 159, 160, 152, 342, 439/466, 468, 752
See application file for complete search history.

(56) References Cited

U.S. PATENT DOCUMENTS 4,838,809 A * 6/1989 Mouissie ..... 439/467
5,295,859 A * 3/1994 Kawai et al. ..... 439/466
5,312,268 A * 5/1994 Sumida ..... 439/701
5,326,279 A 7/1994 Sumida
5,672,078 A * 9/1997 Fukamachi et al. ..... 439/701
5,695,358 A * 12/1997 Myer et al. ..... 439/468
5,855,486 A 1/1999 Fukamachi et al.
6,095,852 A 8/2000 Gregory, II
2003/0100228 A1* 5/2003 Bungo et al. ..... 439/701

FOREIGN PATENT DOCUMENTS

JP 2001-196132 7/2001

* cited by examiner

*Primary Examiner*—Felix O. Figueroa
(74) *Attorney, Agent, or Firm*—Gerald E. Hespos; Anthony J. Casella

(57) ABSTRACT

A divided connector has a cover (70) that is mounted on a frame (10) in a direction orthogonal to an inserting direction of auxiliary housings (40) into the frame (10). Latches (71) on the inner surfaces of the cover (70) contact guide surfaces (42B) of an insufficiently inserted auxiliary housing (40) to push the auxiliary housing (40) to a proper position and doubly lock the auxiliary housing (40).

5 Claims, 18 Drawing Sheets

DIVIDED CONNECTOR AND METHOD OF ASSEMBLING IT

BACKGROUND OF THE INVENTION

1. Field of the Invention

The invention relates to a divided connector that accommodates auxiliary housings in a frame and to a method of assembling it.

2. Description of the Related Art

Japanese Unexamined Patent Publication No. 2001-196132 discloses a divided connector with a frame that has accommodating chambers. Auxiliary housings are inserted into the accommodating chambers from behind and terminal fittings secured to ends of wires are mounted in the auxiliary housings. A retaining piece is provided in each accommodating chamber and retains the auxiliary housing that has been inserted to a proper depth.

The wires drawn out from the auxiliary housings are bundled and guided in a specified direction by a cover mounted on the rear surface of the frame. Contacts are provided on the inner surface of the cover. The contacts engage the rear surfaces of the auxiliary housings when the cover is mounted properly to doubly lock the auxiliary housings with respect to the withdrawing direction. Further, the contacts push any insufficiently inserted auxiliary housing to a proper insertion position and then doubly lock the auxiliary housing.

The above-described cover is mounted on the rear surface of the frame in the same direction as the inserting direction of the auxiliary housings and resiliently deformable locking pieces on the cover or the frame engage mating locking projections to lock the cover. The resiliently deformable locking pieces describe pivotal paths in a direction orthogonal to the cover mounting direction while engaging the locking projections. Thus, clearances are required near the locking projections after the cover is locked. Accordingly, there is a possibility that the cover or the contacts are behind proper positions so that a clearance is created to the rear surfaces of the auxiliary housings even if the cover is mounted and locked. As a result, the double locking is not very reliable. Further, the contact may not engage the rear surface of the auxiliary housing even if the auxiliary housing is left insufficiently inserted, and the auxiliary housing may remain insufficiently inserted.

The present invention was developed in view of the above problem and an object thereof is to securely detect the insufficient insertion of auxiliary housings and doubly lock the auxiliary housings using a cover.

SUMMARY OF THE INVENTION

The invention relates to a divided connector with a frame that has accommodating chambers. Auxiliary housings are mounted in the accommodating chambers and terminal fittings secured to ends of wires are mounted in the auxiliary housings. At least one cover is mountable to at least partly cover a surface of the frame. The cover is mounted by being moved along a mounting surface of the frame in a direction that intersects the inserting direction of the auxiliary housings and is locked by a locking mechanism upon reaching a proper mount position. The cover has latches that move along surfaces of the auxiliary housings during movement of the cover if the auxiliary housings are located properly in the frame. The latches engage the surfaces of the auxiliary housings that have reached the proper mount position, but interfere with any auxiliary housing that has been inserted insufficiently.

The cover is moved along the mounting surface of the frame in a direction intersecting the inserting direction of the auxiliary housings. The cover may shake along the moving direction to a certain extent. However, the cover does not shake significantly in the inserting direction of the auxiliary housings. Accordingly, the latches on the cover engage and lock the auxiliary housings with high reliability. The latch contacts the end of any auxiliary housing that has been inserted insufficiently for securely detecting the insufficient insertion.

The accommodating chambers preferably have resiliently deflectable retaining portions that retain the auxiliary housings when the auxiliary housings are inserted to proper positions.

The cover preferably is mounted by being slid along the rear surface of the frame.

The latches and the auxiliary housings preferably have slanted guide surfaces that contact as the cover is being mounted if an auxiliary housing is left insufficiently inserted. The slanted guide surfaces are aligned to push the auxiliary housing to a proper insertion position by a moving force of the latch. Thus, an insufficiently inserted auxiliary housing is inserted automatically to the proper position as the cover is mounted.

The cover preferably is mounted first in substantially the same direction as the inserting direction of the auxiliary housings to a position retracted along the operating direction from the proper mount position on the mount surface of the frame. The cover then is moved on the mounting surface of the frame in the direction intersecting the inserting direction of the auxiliary housings to the proper mount position. This arrangement is helpful for situations where there is little space adjacent side surfaces of the frame.

At least one resiliently deformable return stopping protuberance preferably is provided on the frame and is resiliently deformed by an inner surface of the cover as the cover is moved. The return stopping protuberance then is restored to prevent the cover from returning.

One or more protrusions preferably are provided in each accommodating chamber. The protrusions engage locking edges of the auxiliary to stop the auxiliary housing at its insertion stop position.

The invention also relates to a method of assembling a divided connector. The method comprises inserting auxiliary housings along an inserting direction into accommodating chambers formed in a frame. The method then includes moving a cover along a mounting surface of the frame in a direction intersecting the inserting direction of the auxiliary housings and locking the cover by a locking mechanism upon reaching a proper mount position. Latches move along surfaces of the auxiliary housings during a movement of the cover if the auxiliary housings are properly located in the frame and engage the surfaces of the auxiliary housings upon reaching the proper mount position. However, the latches interfere with the auxiliary housings if the auxiliary housings are inserted insufficiently in the frame.

The method may comprise pushing an auxiliary housing to a proper position by a moving force of the latch during the movement of the cover.

The cover preferably is first mounted in substantially the same direction as the inserting direction of the auxiliary housings towards a position retracted backward with respect to the operating direction from the proper mount position on the mount surface of the frame, and then is moved on the mounting surface of the frame in the direction intersecting with the inserting direction of the auxiliary housings to the proper mount position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector and a male connector according to the invention are identified generally by the letters F and M in FIGS. 1 to 18. The female connector F is a divided connector that can be connected with the male connector M. In the following description, the end of each connector F, M that is to be connected is referred to as the front concerning forward and backward directions FBD. Reference is made to transverse direction in FIG. 2 concerning transverse direction and reference is made to vertical direction in FIG. 8 concerning width direction.

Figure 8:
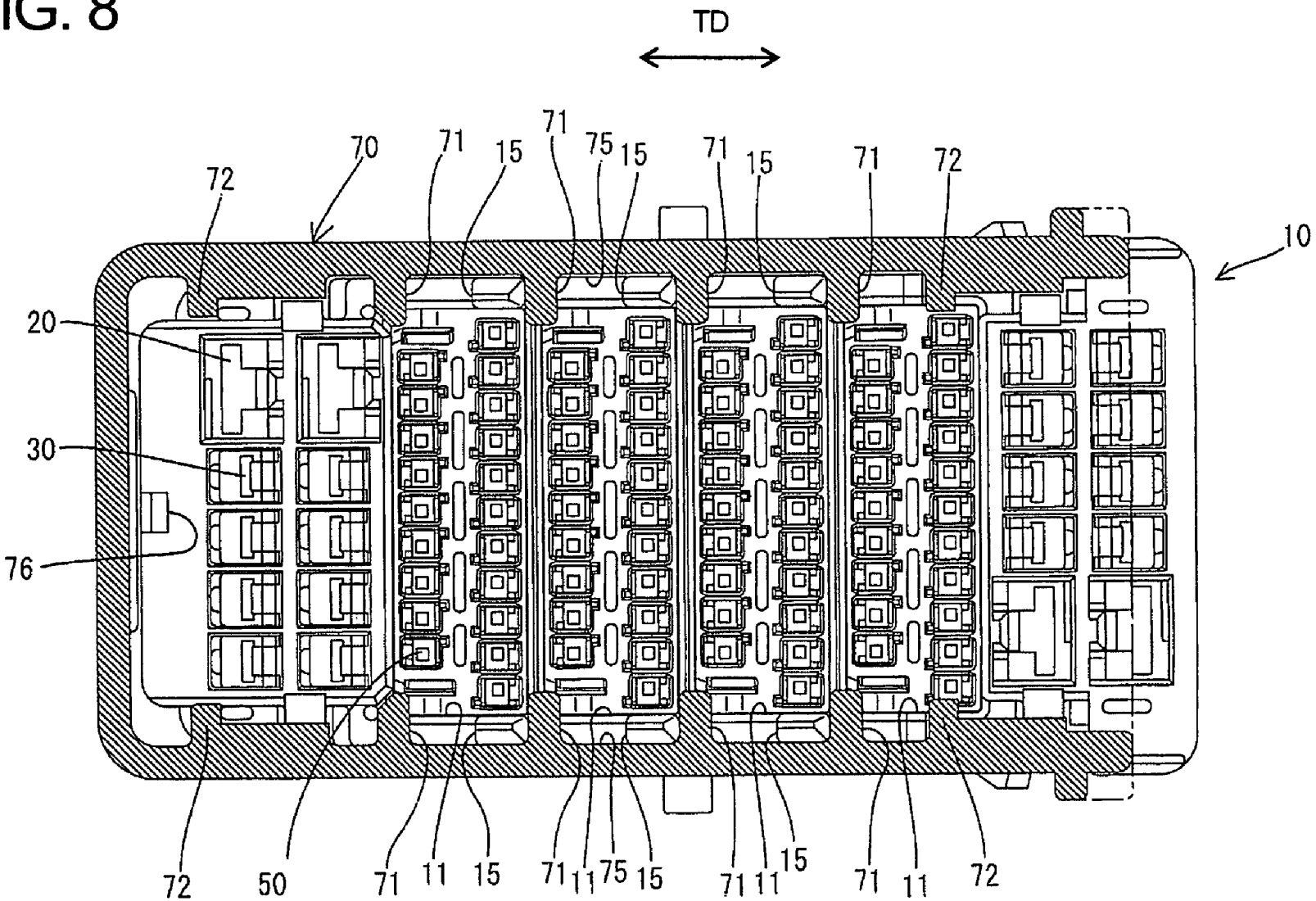
FIG. 8 is a horizontal section of the female connector when the cover is at the retracted position.
Figure 9:
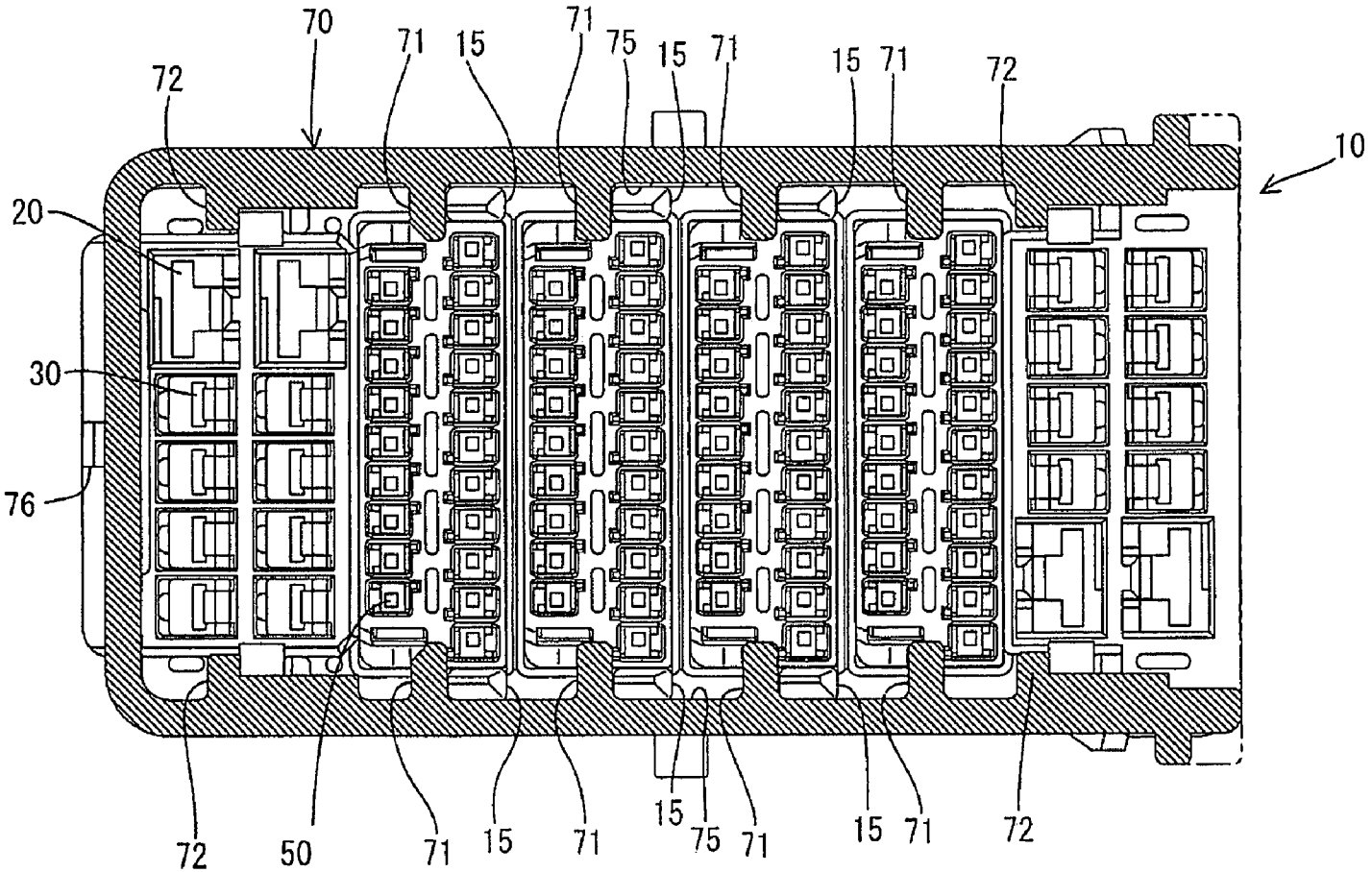
FIG. 9 is a horizontal section of the female connector when the cover is at the proper mount position.
Figure 10:
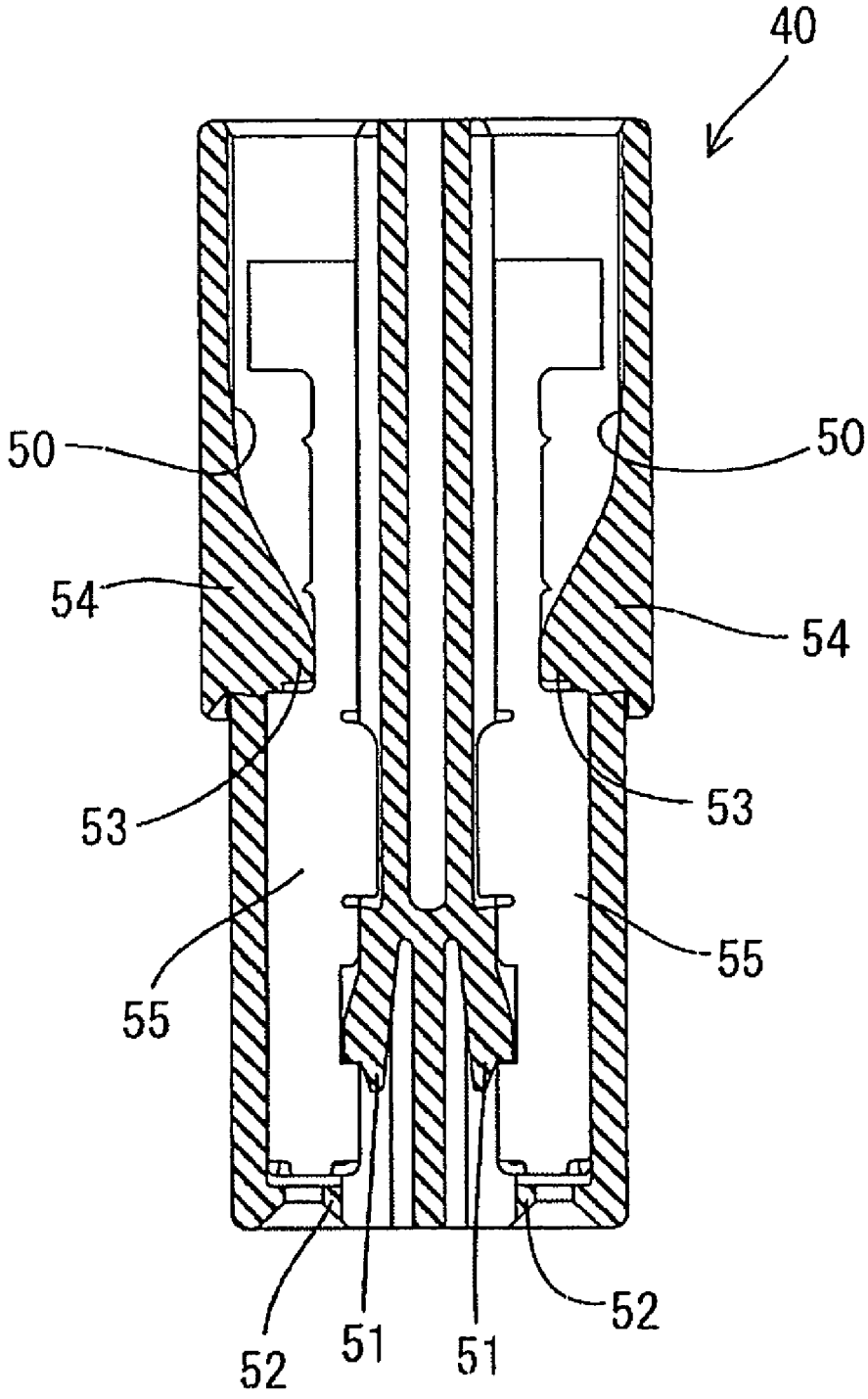
FIG. 10 is a vertical section of an auxiliary housing.

The female connector F includes a wide block-shaped frame 10 made e.g. of a synthetic resin. Four accommodating chambers 11 are arranged in an inner middle part of the frame 10 and cavities 20, 30 are arranged therein. More particularly, as shown in FIG. 8, two large cavities 20 and eight medium cavities 30 are arranged at each side and are substantially symmetric with respect to a transverse direction TD. Female terminal fittings (not shown) having different sizes and shapes can be accommodated in the cavities 20, 30. The female terminal fittings are stopped at front-stop positions by front walls 22, 32 and can be retained by resiliently deflectable locks 21, 31 in the cavities 20, 30. Male tabs of male terminal fittings (not shown) are insertable into the respective female terminal fittings through front openings 23, 33 to establish electrical connection between the female and male connectors F and M.

The accommodating chambers 11 of the frame 10 are hollow in forward and backward directions FBD and arranged substantially side by side along the transverse direction TD with partition walls 12 between adjacent accommodating chambers 11. Two protrusions 19 are provided at the opposite ends of each accommodating chamber 11 and two resiliently deformable retaining portions 13 are provided at the front ends of the protrusions 19 in each accommodating chamber 11. An unlocking piece 16 projects in an intermediate position of the leading end of each retaining portion 13. As shown in FIG. 8, stopper walls 15 are formed at six positions close to the rear edge of the frame 10 and project back. In this embodiment, the stopper walls 15 are provided in only three of the four accommodating chambers 11.

Figure 18:
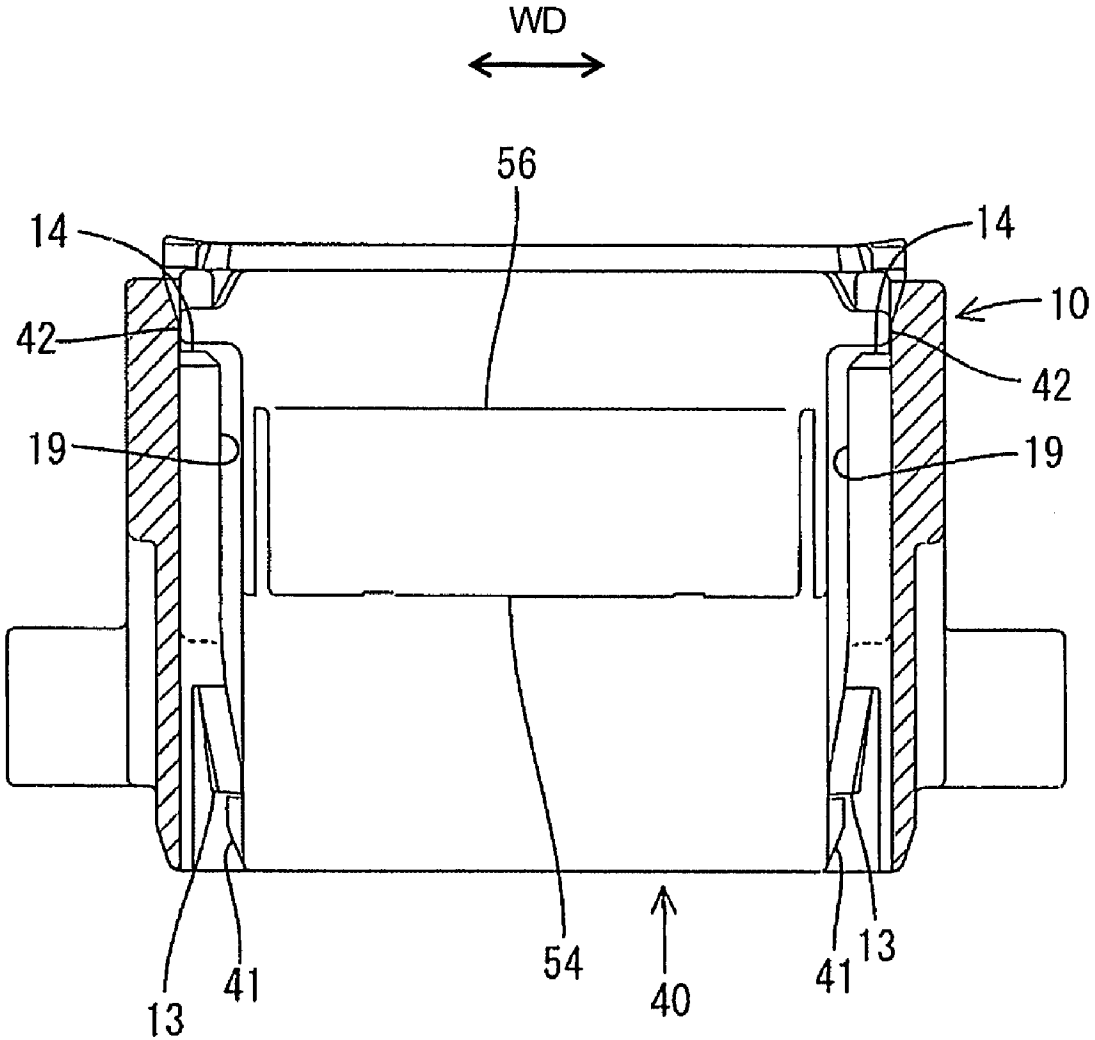
FIG. 18 is a side view in section of the frame showing a locked state of the frame and the auxiliary housing.

Auxiliary housings 40 are insertable into the accommodating chamber 11 from behind. Each auxiliary housing 40 is made e.g. of a synthetic resin and is in the form of a wide block. Cavities 50 are formed at upper and lower stages of each auxiliary housing 40, and resiliently deflectable locks 51 are formed back-to-back in adjacent upper and lower cavities 50 for locking female terminal fittings 55. As shown in FIG. 18, retainers 54 are coupled to the upper and bottom surface(s) of the auxiliary housing 40 via hinge edges 56 and can open and close. The retainers 54 have locking projections 53 that project in correspondence with the respective female terminal fittings 55, and the locking projections 53 can engage the female terminal fittings 55 when the retainers 54 are closed with respect to the auxiliary housing 40.

Figure 13:
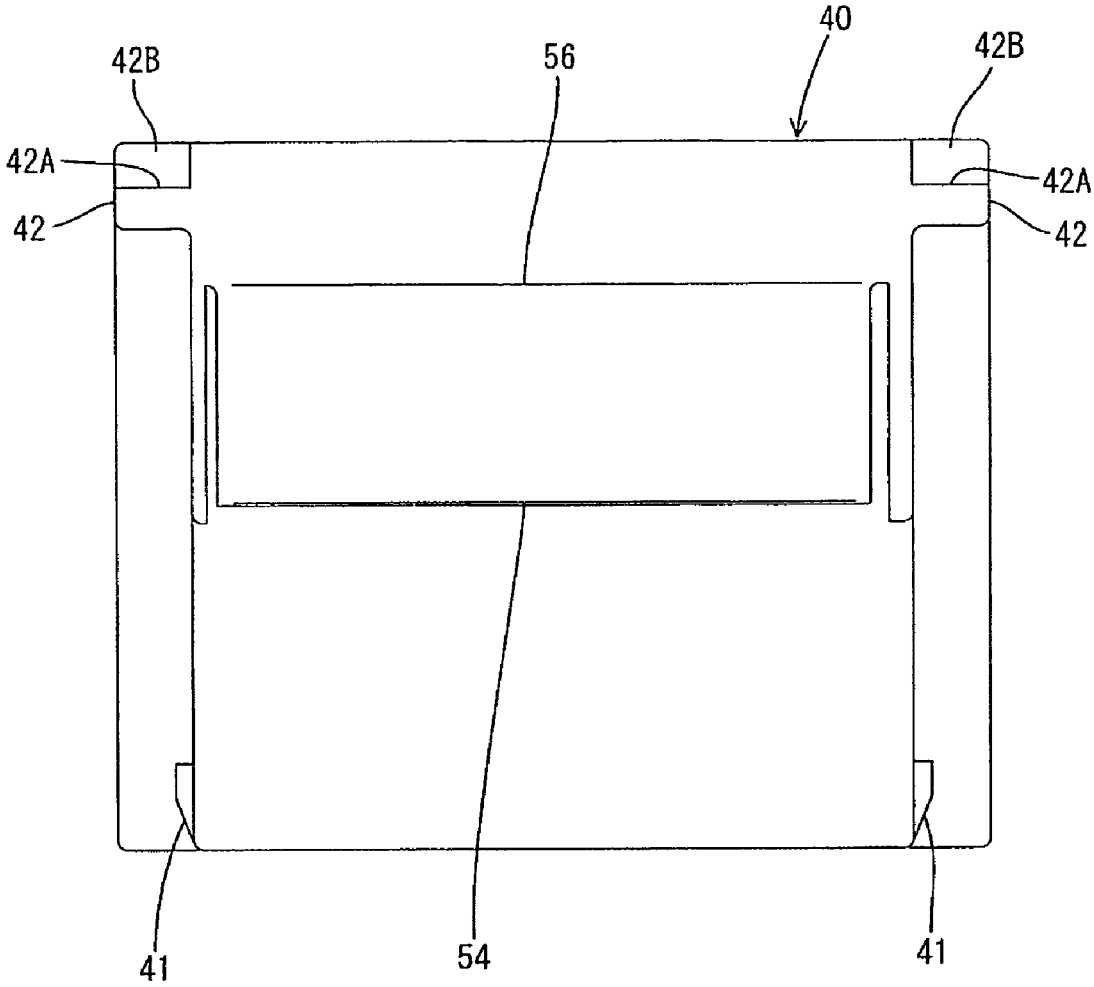
FIG. 13 is a front view of the auxiliary housing.
Figure 14:
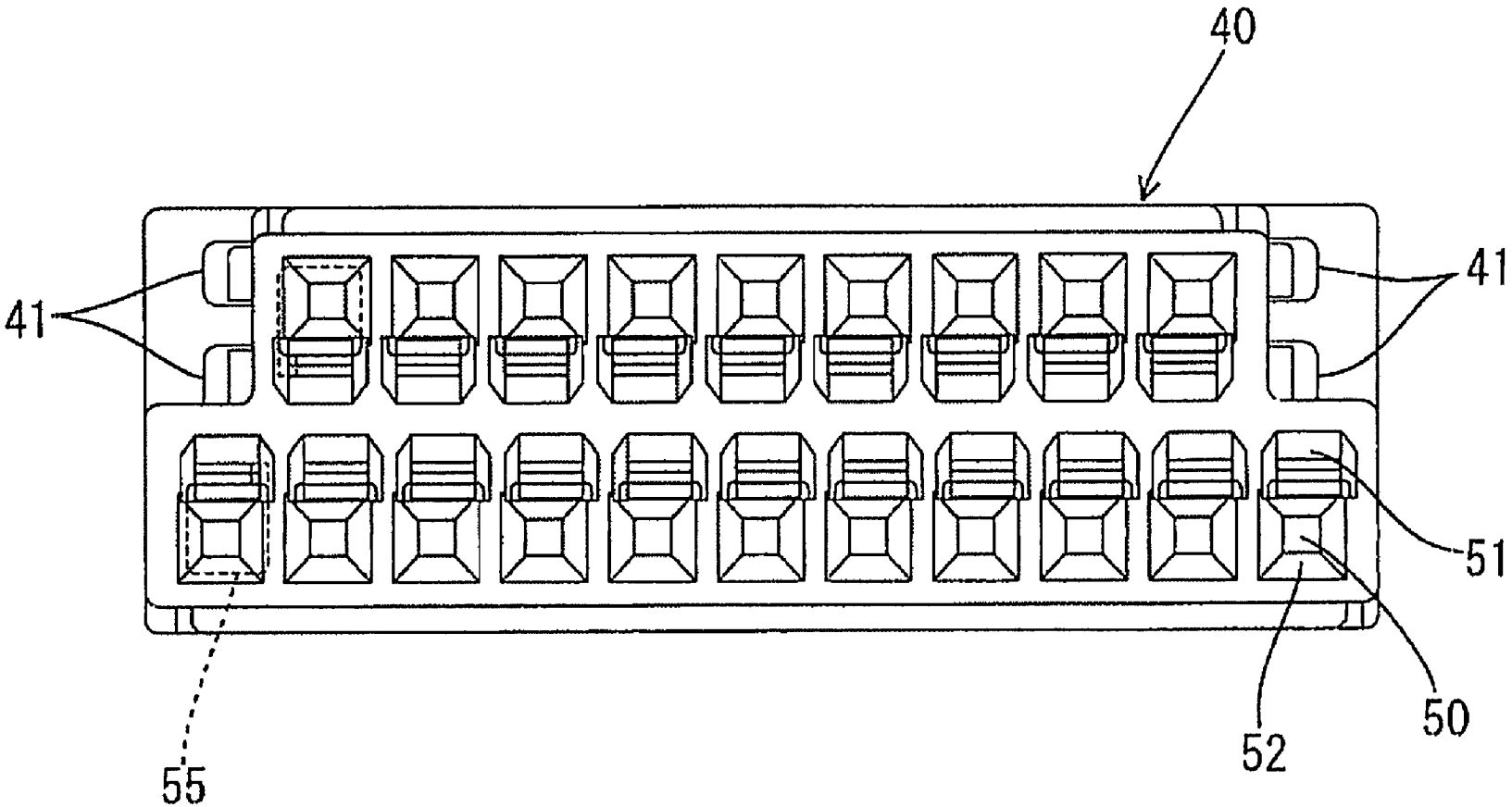
FIG. 14 is a bottom view of the auxiliary housing.
Figure 15:
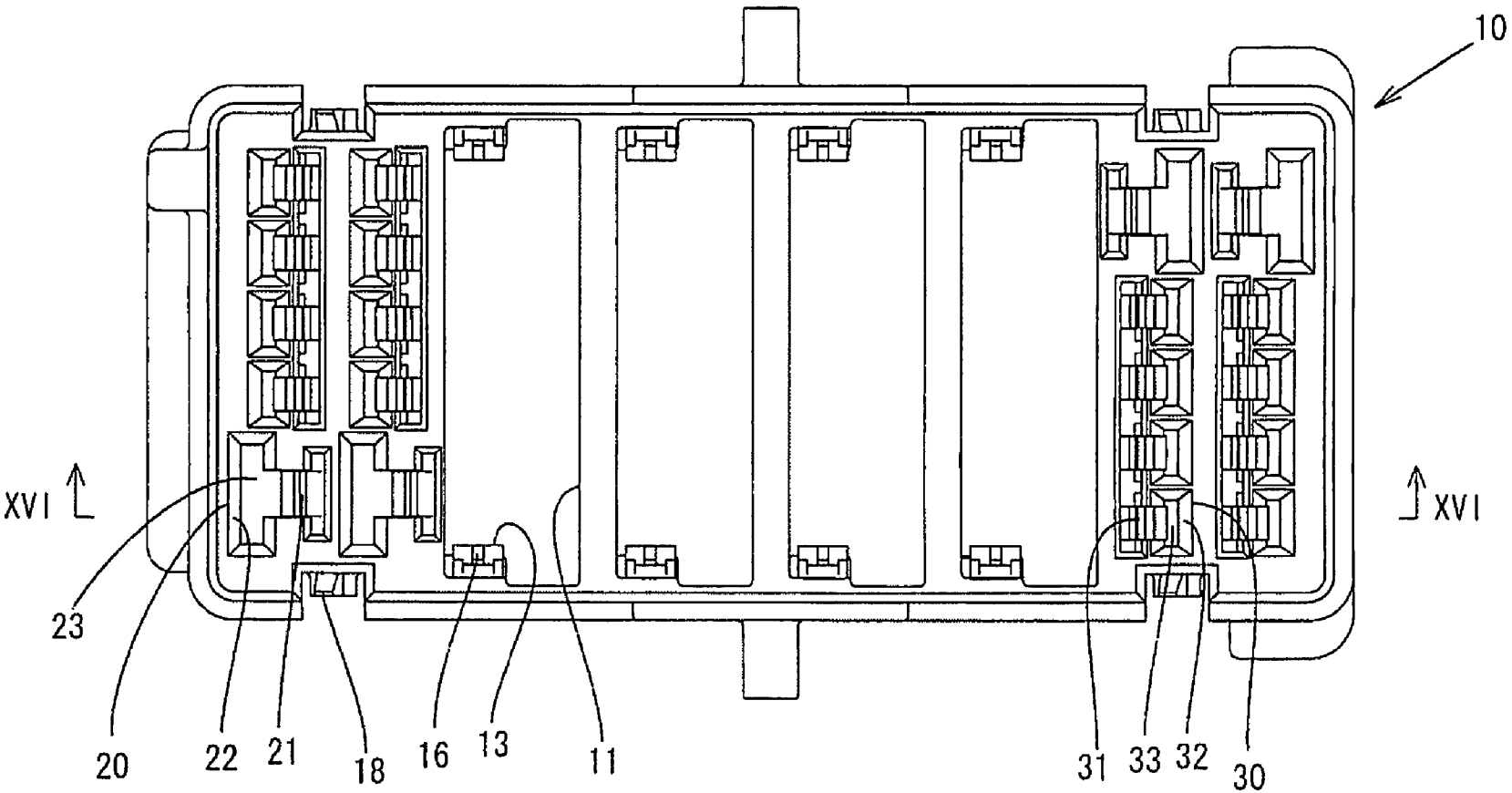
FIG. 15 is a bottom view of a frame.
Figure 16:
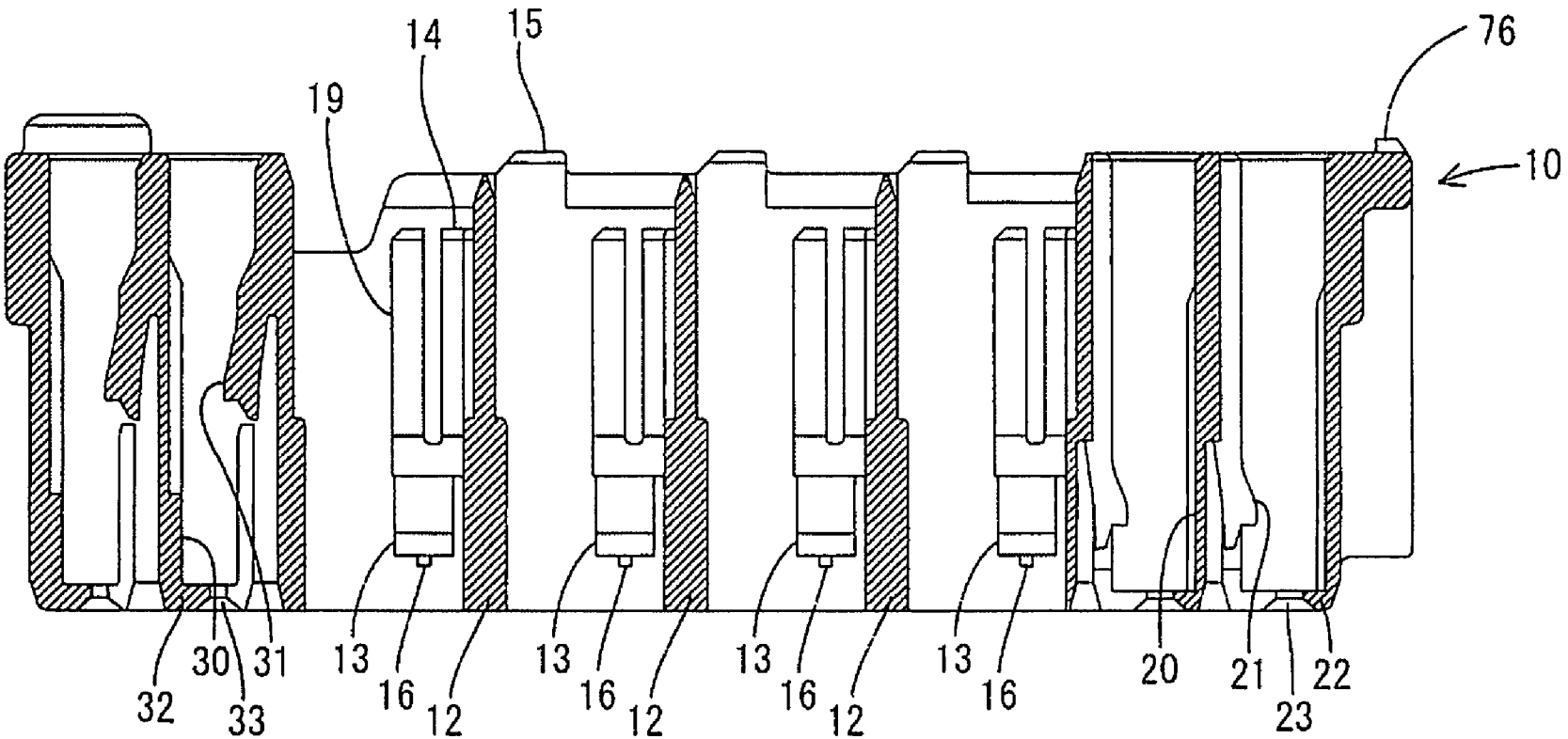
FIG. 16 is a section along XVI—XVI of FIG. 15.
Figure 17:
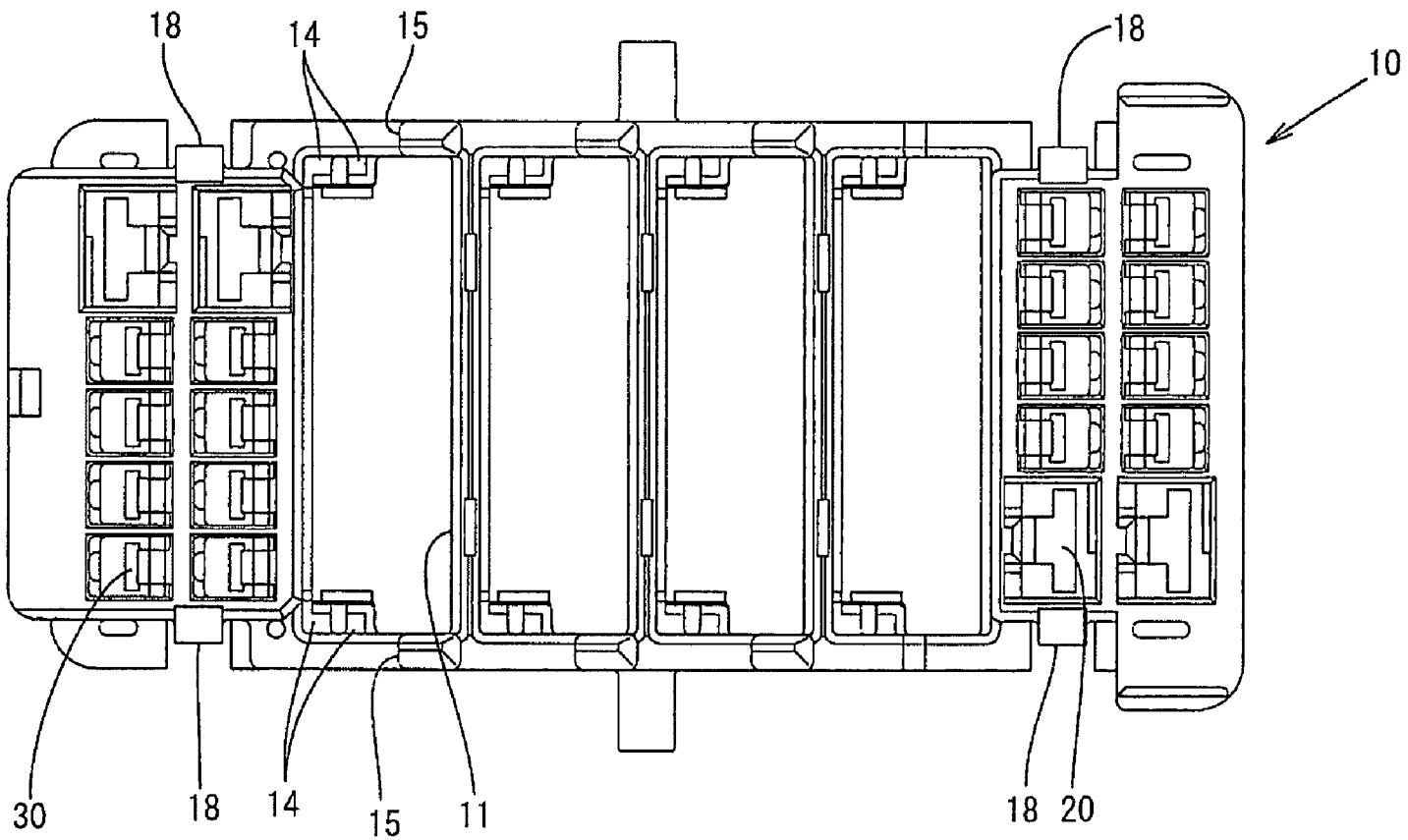
FIG. 17 is a plan view of the frame.

The upper portion of each auxiliary housing 40 is narrower than the lower portion, as shown in FIGS. 13 and 14. Two locking projections 41 are provided one over the other, with a clearance therebetween, at the front end of each of the opposite widthwise side surfaces of the upper portion of the auxiliary housing 40. The locking projections 41 both can be hooked by the retaining portion 13, and the unlocking piece 16 is between the locking projections 41. The unlocking pieces 16 can be manipulated by an unillustrated jig to disengage the retaining portions 13 from the auxiliary housing 40. Further, two locking edges 42 are provided close to the rear ends of the opposite side surfaces of the upper stage of the auxiliary housing 40. Both locking edges 42 bulge out in the width direction WD substantially to the corresponding opposite side surfaces of the lower stage of the auxiliary housing 40, and the upper ends thereof are substantially flush with the upper surface of the upper stage of the auxiliary housing 40. An upper part of the rear surface of each locking edge 42 has a horizontal surface 42A spaced forward from the rear surface of the auxiliary housing 40. A lower part of the rear surface of each locking edge 42 is connected with the rear surface of the auxiliary housing 40 via a moderately inclined guide surface 42B. A dimension of the auxiliary housing 40 along forward and backward directions FBD is substantially equal to the corresponding dimension of the accommodating chamber 11. At a substantially proper position, the front end surface of the auxiliary housing 40 preferably is substantially flush with the front of the accommodating chamber 11 and the rear end surface of the auxiliary housing 40 is substantially flush with the rear of the accommodating chamber 11.

Figure 1:
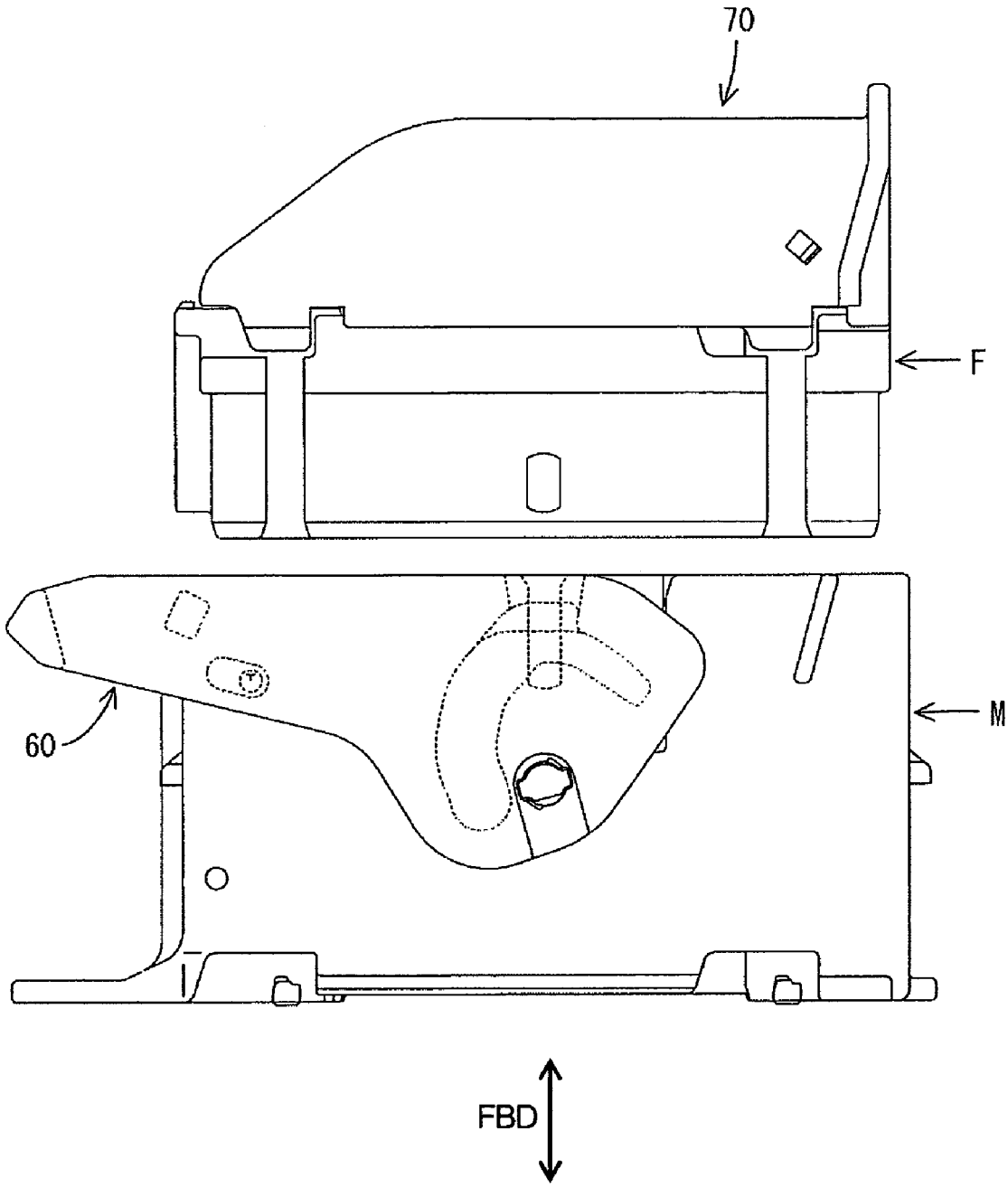
FIG. 1 is a side view showing a state before a female connector and a male connector are connected.
Figure 2:
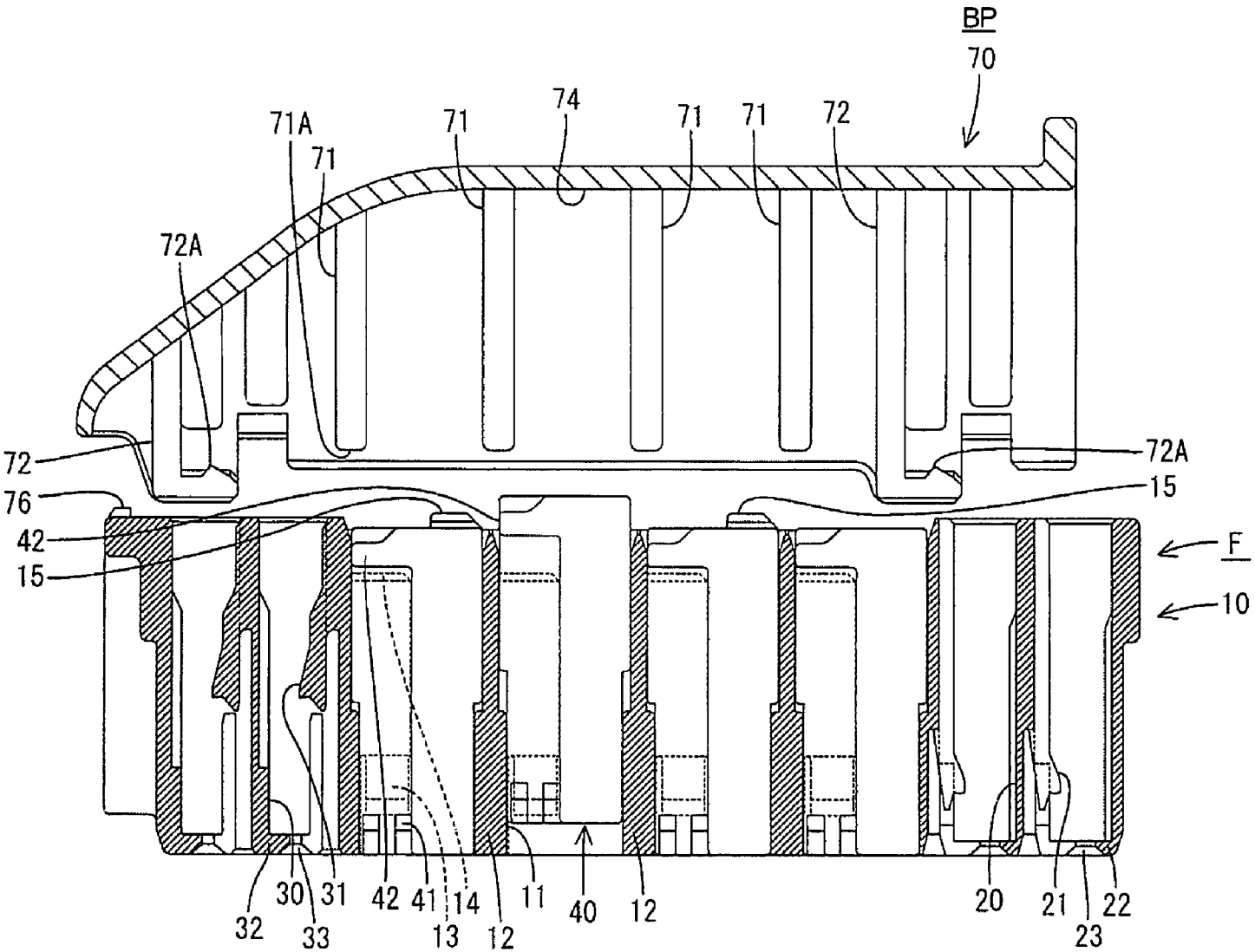
FIG. 2 is a vertical section of the female connector before a cover is mounted.
Figure 3:
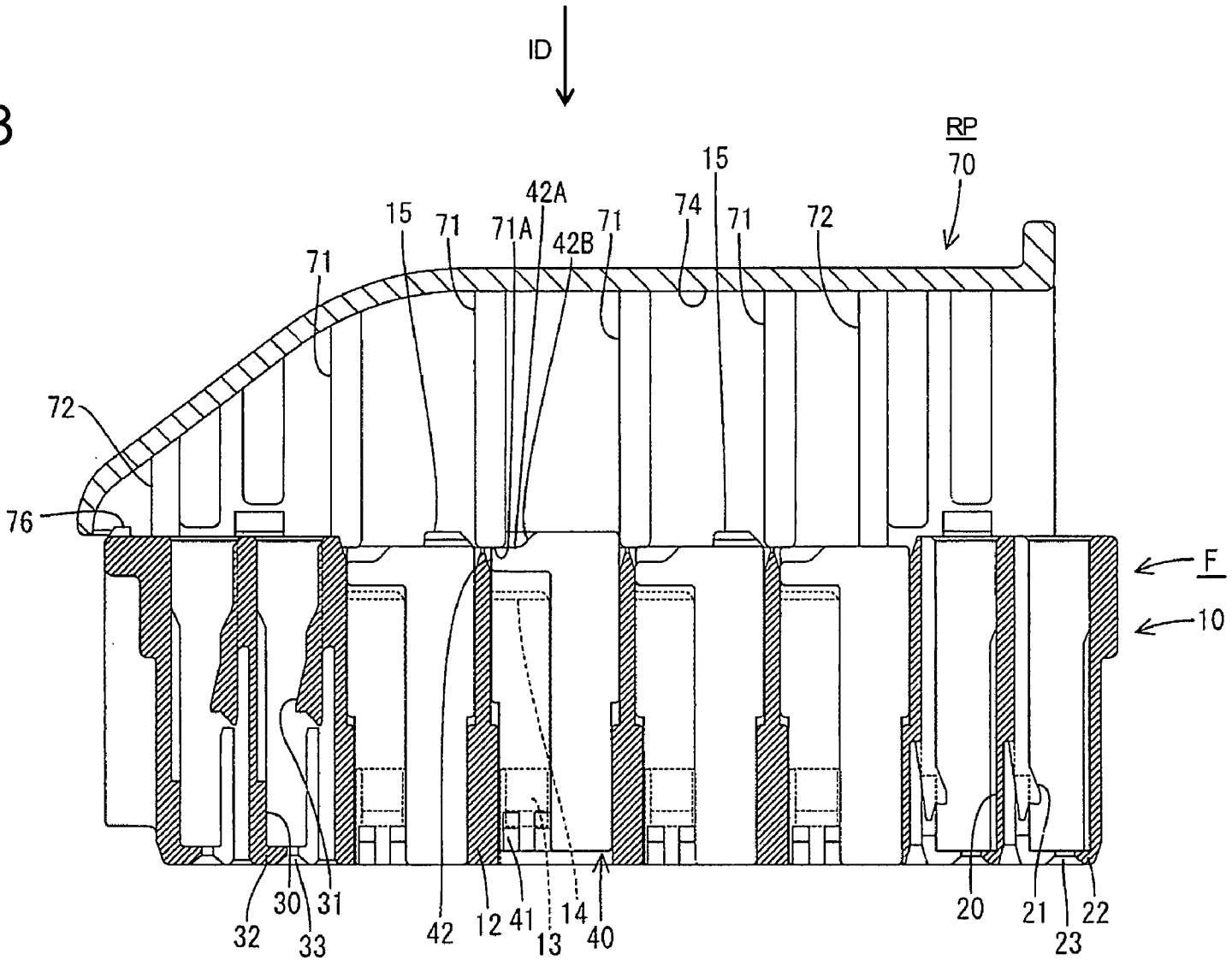
FIG. 3 is a vertical section of the female connector when the cover is at a retracted position.
Figure 4:
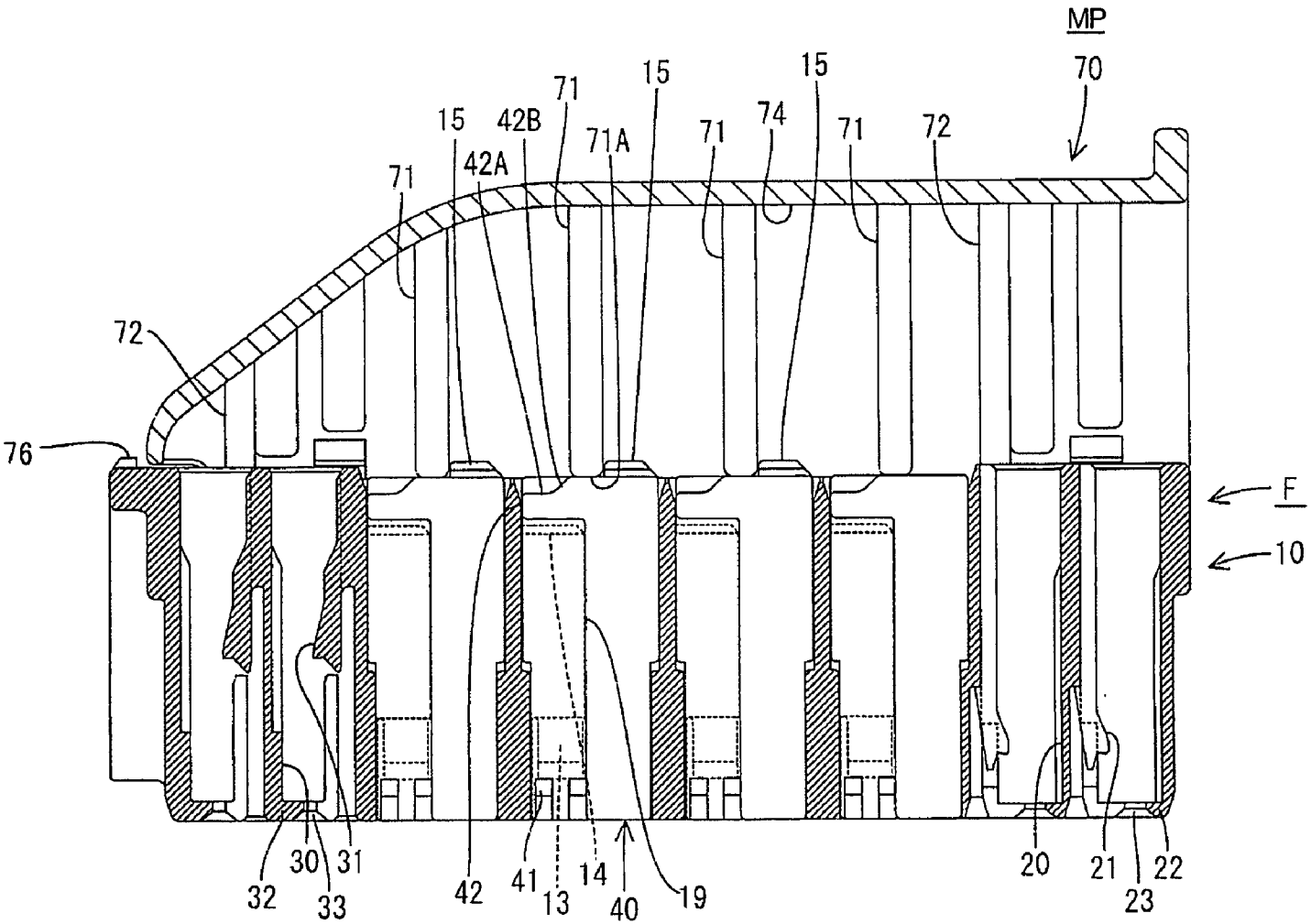
FIG. 4 is a vertical section of the female connector when the cover is at a proper mount position.

A cover 70 is mountable on the rear surface of the frame 10. The cover 70 is made e.g. of a synthetic resin, and has a hollow shape configured to cover the rear surface of the frame 10. A ceiling 74 is formed on the cover 70 and slopes laterally down, as shown in FIGS. 2 and 8. Upon being mounted on the frame 10, the cover 70 first is pushed forward with respect to the frame 10 in the inserting direction ID from a backward position BP, shown in FIGS. 2 and 5, to a retracted position RP, shown in FIGS. 3 and 6. The cover 70 then is slid laterally to the right and substantially normal to the inserting direction ID on the rear surface of the frame 10 from the retracted position RP to a proper mount position MP, shown in FIGS. 4 and 7.

Figure 5:
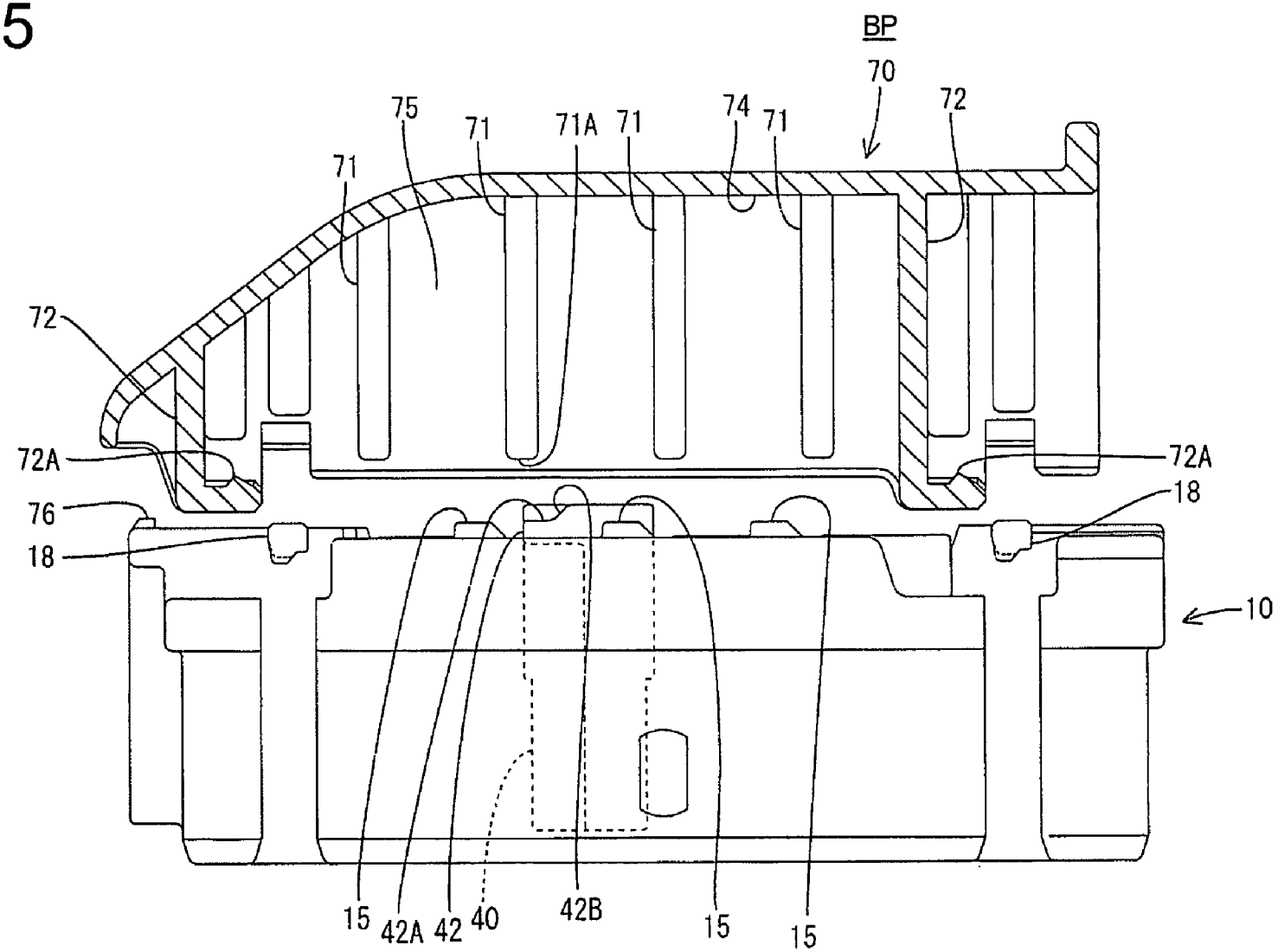
FIG. 5 is a side view partly in section of the female connector before the cover is mounted.
Figure 6:
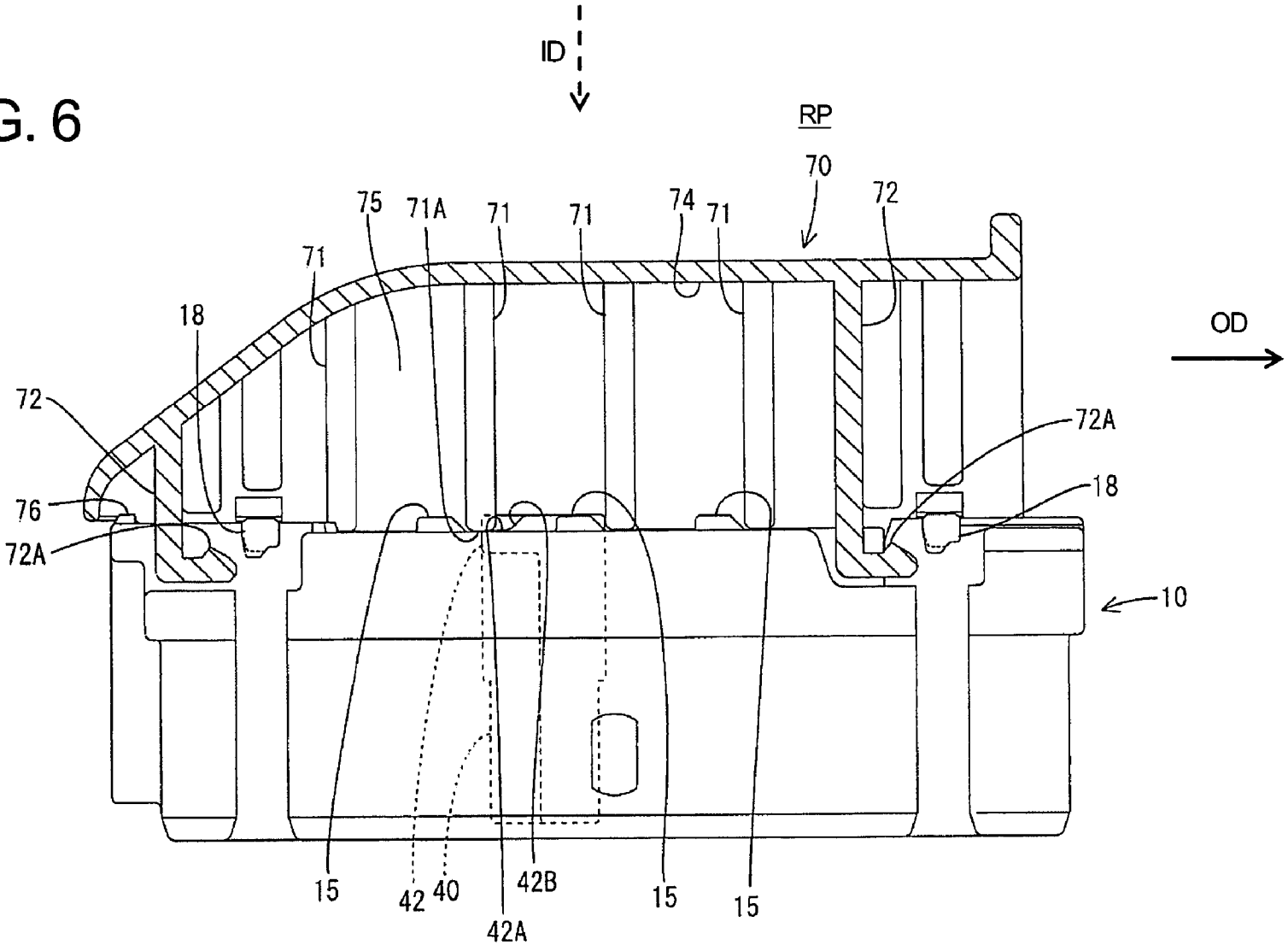
FIG. 6 is a side view partly in section of the female connector when the cover is at the retracted position.
Figure 7:
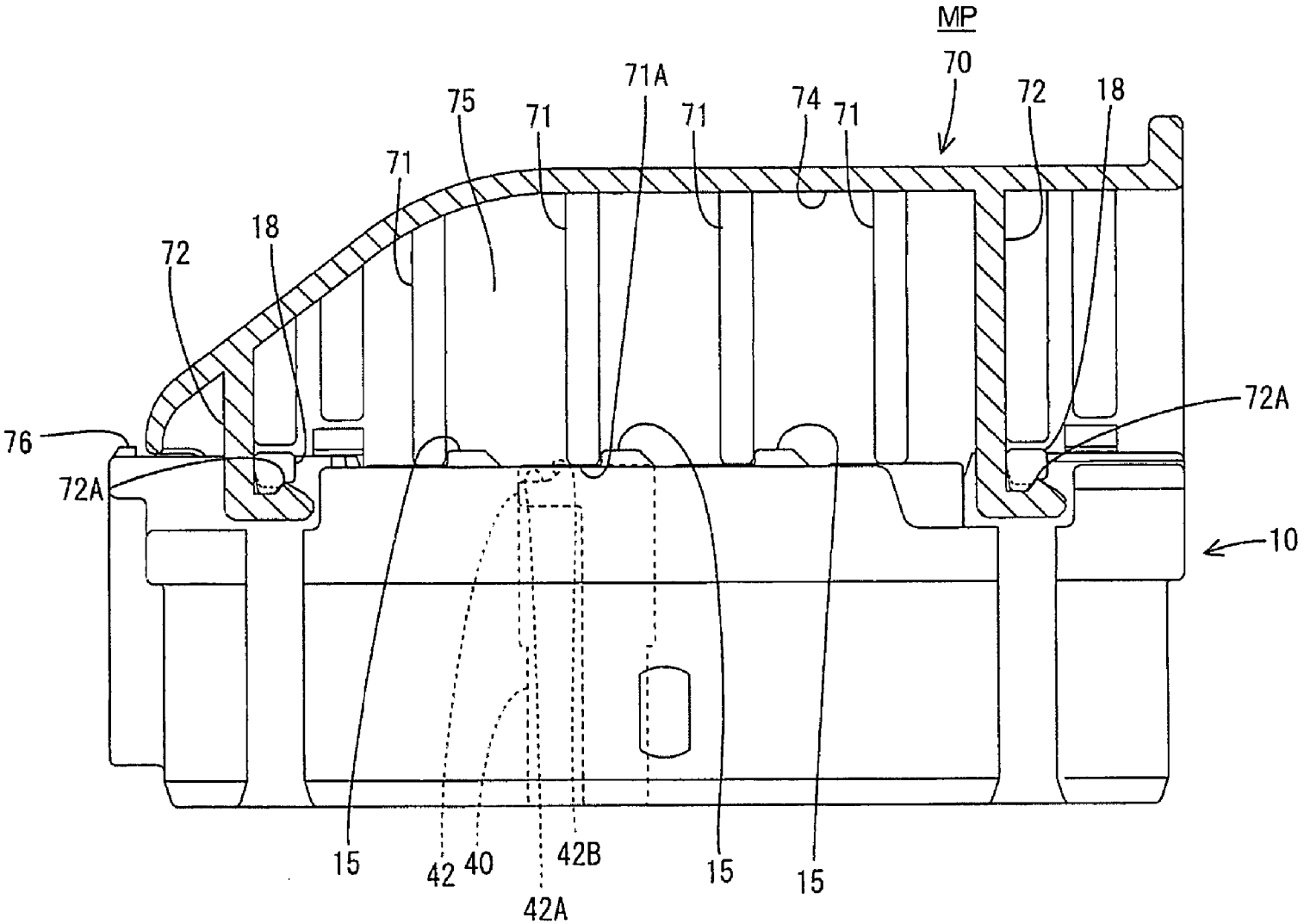
FIG. 7 is a side view partly in section of the female connector when the cover is at the proper mount position.
Figure 11:
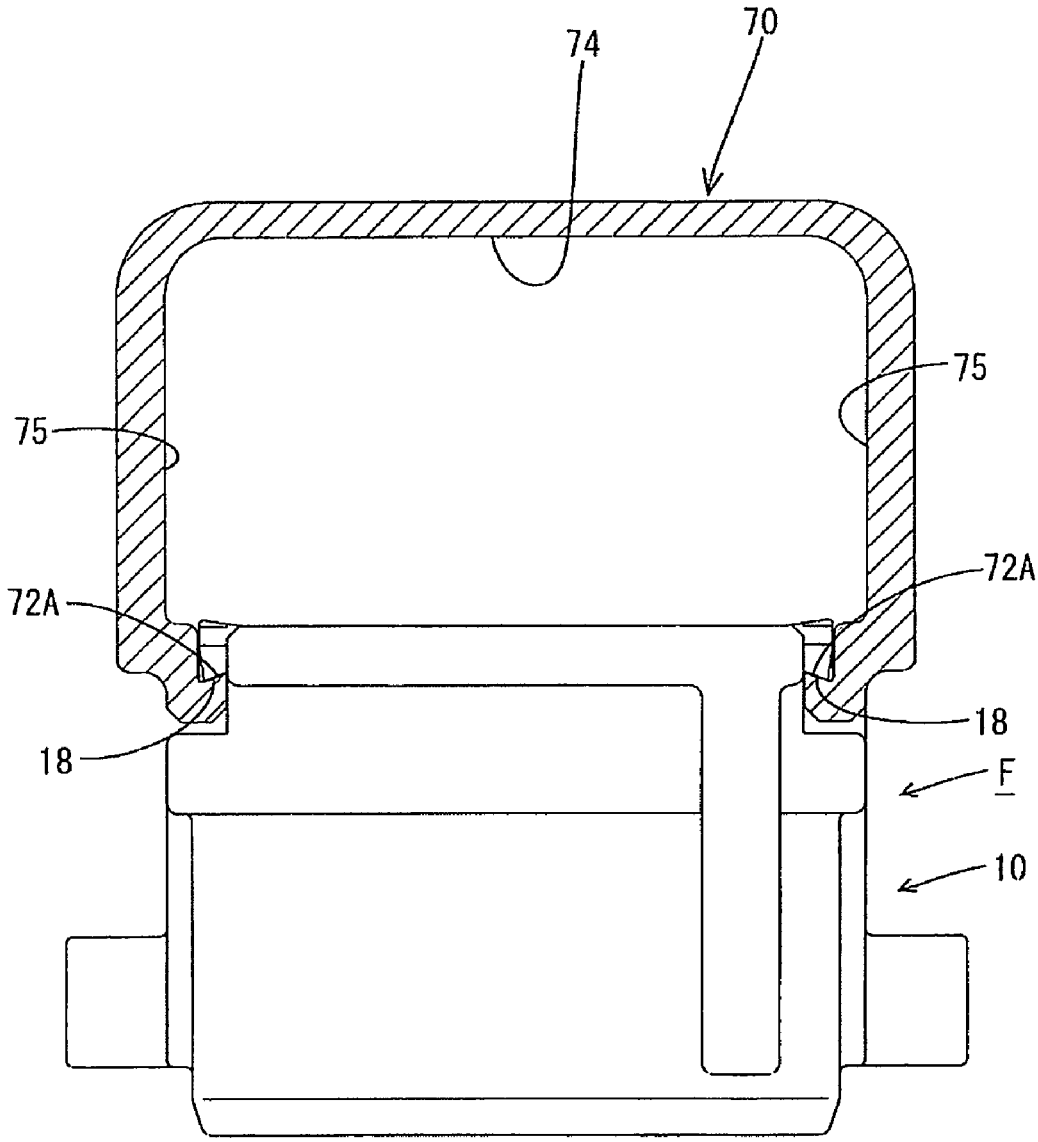
FIG. 11 is a front view partly in section of the female connector when the cover is partly locked.
Figure 12:
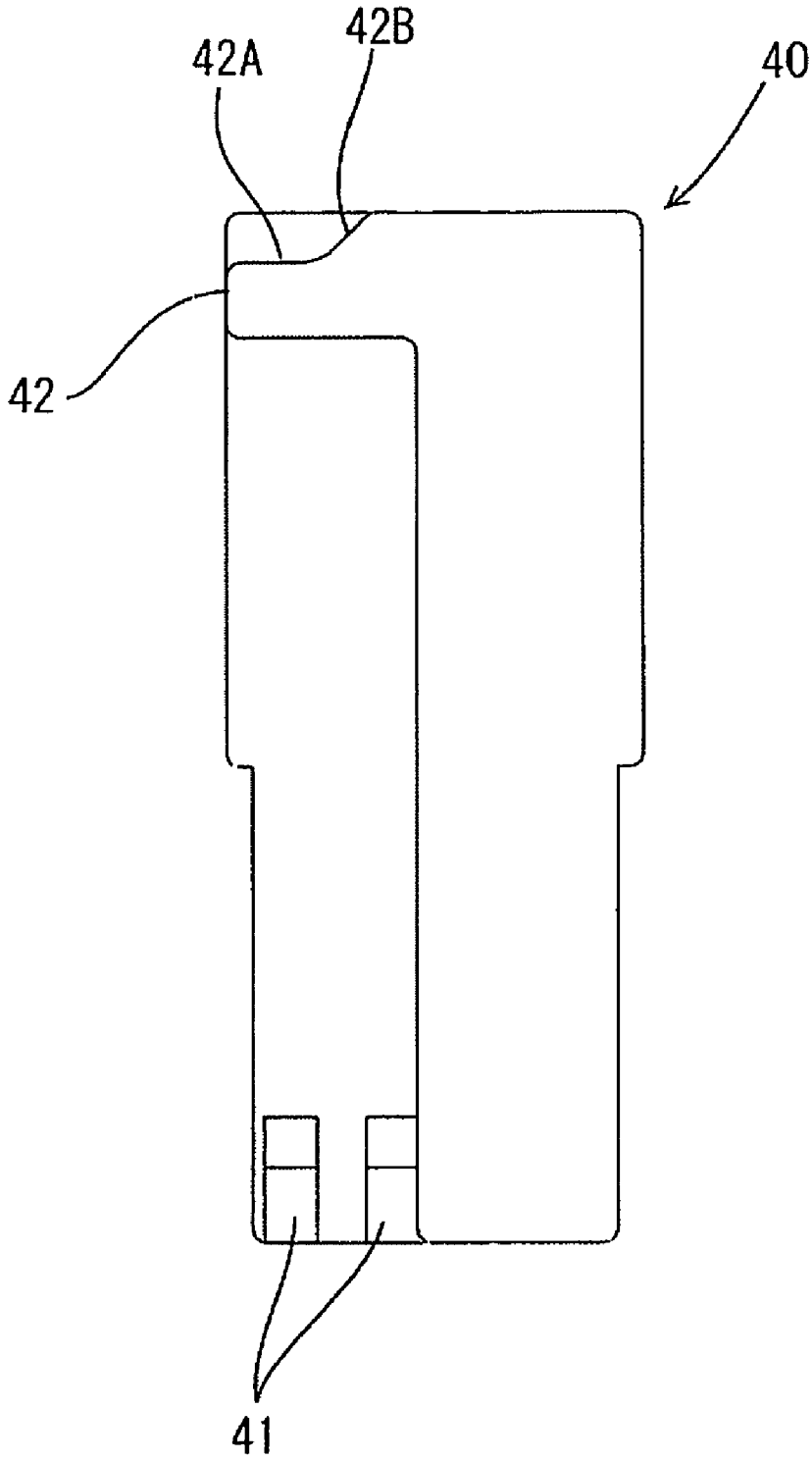
FIG. 12 is a side view of the auxiliary housing.

As shown in FIG. 8, latches 71 and lock arms 72 are formed unitarily on the opposite widthwise inner surfaces 75 of the cover 70. The lock arms 72 extend towards the frame 10 and connect with the ceiling 74 and the opposite side surfaces 75, as shown in FIGS. 5 to 7. The lock arms 72 extend more towards the frame 10 than the front edge of the cover 70 and then are bent by substantially 90° at the front ends to extend in an operating direction OD (rightward in FIG. 6) of the cover 70. Thus, the lock arms 72 are substantially L-shaped. The bent parts are resiliently deformable and lock projections 72A are provided at the leading ends of bent parts. The lock arms 72 hold opposite widthwise side surfaces of parts of the frame 10 that have the large and medium cavities 20, 30 when the cover 70 is at the retracted position RP with respect to the frame 10 and position the frame 10 with respect to the width direction WD. The lock projections 72A are behind the engaging portions 18 with respect to the cover operating direction OD when the cover 70 is at the retracted position RP. The lock projections 72A engage the engaging portions 18 when the cover 70 reaches the proper mount position MP shown in FIG. 7 to prevent the cover 70 from returning towards the retracted position RP. As shown in FIG. 11, lower parts of the engaging portions 18 turn in towards each other and in substantially opposite directions along the width direction WD. However, upper parts of the lock projections 72A are turned out away from each other substantially in opposite directions along width direction WD. The lock projections 72A and the engaging portions 18 engage each other at the proper mount position MP to prevent the opposite widthwise side surfaces of the cover 70 from moving away from each other along width direction WD and prevent the cover 70 from coming off backward.

As shown in FIGS. 2 to 5, the latches 71 are substantially parallel rectangular columns, arranged at substantially even intervals within a longitudinal area defined by the left and right lock arms 72. The latches 71 are connected with the ceiling 74 and the opposite side surfaces 75 of the cover 70, and front ends 71A of the latches 71 are retracted slightly from the front edge of the cover 70. The front ends 71A of the latches 71 contact the rear surface of the frame 10 at opposite widthwise side surfaces of the frame 10 when the cover 70 is at the retracted position RP on the frame 10. The front ends 71A then slide on the rear surface of the frame 10 as the cover 70 moves from the retracted position RP to the proper mount position MP. As described above, the respective latches 71 correspond to the accommodating chambers 11 of the frame 10. Thus, the latches 71 are behind the horizontal surfaces 42A of the respective auxiliary housings 40 in the accommodating chambers 11 when the cover 70 is at the retracted position RP. Accordingly, the front ends 71A of the latches 71 push the horizontal surface 42A of any auxiliary housing 40 that has been inserted insufficiently in the accommodating chamber 11. Thus, the horizontal surfaces 42A can be made substantially flush with the opening edge of the accommodating chamber 11 in the process of mounting the cover 70 at the retracted position RP. At this time, the front ends 71A contact the opening edge of the frame 11 so that the entire cover 70 is supported on the frame 11. The front ends 71A of the three latches 71 from the right are at the right ends of the stopper walls 15 when the cover 70 is at the retracted position RP, as shown in FIG. 8. Additionally, the inner surface of the left end of the cover 70 is at the left side of a return stopping protuberance 76 in the middle of the left end of the rear surface of the frame 11, as shown in FIG. 6.

The latches 71 slide on the opening edge of the frame 11 as the cover 70 moves from the retracted position RP to the proper mount position MP. The cover 70 then is held at the proper mount position MP by the contact of the latches 71 with the stopper walls 15 adjacent to the latches 71 at the right side, as shown in FIG. 7. The front ends 71A of the latches 71 slide on the rear surfaces of the auxiliary housings 40 that have been mounted properly in the accommodating chambers 11. Accordingly, the auxiliary housings 40 are retained and doubly locked when the cover 70 reaches the proper mount position MP. However, the cover 70 slides on the guide surfaces 42B while moving in the operating direction OD from the retracted position RP to the proper mount position MP and pushes any auxiliary housing 40 that has been left in the primary connected state. In the meantime, the inner surface of the left end of the cover 70 moves over the return stopping protuberance 76, and is restored resiliently so that a returning movement of the cover 70 is prevented.

The female connector F is assembled by opening the retainers 54 of each auxiliary housing 40 and inserting the female terminal fittings 55 into respective cavities 50. Thus, the locks 51 engage and partly lock the female terminal fittings 55. The female terminal fittings 55 then are locked doubly by closing the retainers 54. The auxiliary housings 40 then are inserted into the respective accommodating chambers 11 of the frame 10 from behind and along the inserting direction ID and pushed till the front end surfaces thereof become substantially flush with the front end surface of the frame 10. At this time, the locking projections 41 of the accommodating chambers 40 engage the respective retaining portions 13 to hold the auxiliary housings 40 at the proper positions. Prior to or after the above operation, two kinds of female terminal fittings (not shown) having different sizes and/or configurations are inserted into the respective large cavities 20 and the medium cavities 30 from behind and along the inserting direction ID. Then, the female terminal fittings are stopped at their front-stop positions by the front walls 22, 32 and locked by the locking portions 21, 31 to have their backward withdrawals prevented.

The wires are drawn out through the rear surface of the frame 10 and are bundled. The cover 70 then is mounted on the rear surface of the frame 10 and accommodates the wires. At this time, the cover 70 is moved from the backward position BP shown in FIG. 2 to the retracted position RP shown in FIG. 3. Thus, the lock arms 72 are at the opposite widthwise side surfaces of the parts of the frame 10 that have the large and medium cavities 20, 30 and at the left sides of the engaging portions 18. Additionally, the front ends 71A of the three latches 71 from the right contact the rear surface of the frame 10 and the rear surfaces of the auxiliary housings 40 at the right sides of the stopper walls 15, as shown in FIG. 8. The cover 70 then is slid to the right and along the operating direction OD. Thus, the front edge of the cover 70 contacts the rear surface of the frame 10 and the latches 71 slide on the opening edge of the frame 10. The latches 71 substantially simultaneously contact the stopper walls 15 at their right sides in FIG. 7. In this way, the cover 70 is held at the proper mount position MP, and the lock projections 72A engage the engaging portions 18, as shown in FIG. 7, to prevent the cover 70 from returning towards the retracted position RP. In the meantime, the inner surface of the left end of the cover 70 moves over the return stopping protuberance 76, and is restored to prevent the cover 70 from returning. Further, as shown in FIG. 11, the engaging portions 18 engage the lock projections 72A so that the opposite side surfaces of the cover 70 are prevented from moving away from each other along the width direction WD. For example, a force may act to widen the space between the side walls of the cover 70 if the wires are shaken in the width direction WD. However, such a force is resisted by the engagement of the engaging portions 18 and the lock projections 72A.

An auxiliary housing 40 may be inserted insufficiently before the cover 70 is mounted. However, the front ends 71A of the latches 71 contact the horizontal surfaces 42A of the locking edges 42 of an insufficiently inserted auxiliary housing 40 when the cover 70 is moved from the backward position BP of FIG. 2 to the retracted position RP of FIG. 3. Thus, the front ends 71A of the latches 71 push the auxiliary housing 40. The front ends 71A of the latches 71 contact opening edge of the frame 10 when the cover 70 is at the retracted position. Thus, the horizontal surfaces 42A and the opening edge of the frame 10 are substantially flush. The cover 70 then is slid in the operating direction OD to the proper mount position MP. As a result, the front ends 71A of the latches 71 contact the guide surfaces 42B, and a component of force pushes the auxiliary housing 40 in the inserting direction ID. The cover 70 then can be slid further to push the auxiliary housing 40 to the proper position. Thus, the front ends 71A of the latches 71 doubly lock the auxiliary housings 40.

An auxiliary housing 40 that is inserted insufficiently in the frame 10 is corrected to a proper position merely by mounting the cover 70. Specifically, the cover 70 is mounted substantially orthogonal to the inserting direction ID of the auxiliary housing 40. Thus, even if the cover 70 and the frame 10 shake along transverse direction TD, they do not shake along forward and backward directions FBD and, hence, the latches 71 contact the auxiliary housings 40 without clearance. Therefore, insufficient insertion of the auxiliary housings 40 can be detected and the auxiliary housings 40 can be locked doubly. The lock arms 72 function both to stop the return of the cover 70 towards the retracted position RP and to prevent the side walls of the cover 70 from moving away from each other. Thus, the construction of the cover 70 is simplified.

The invention is not limited to the above described embodiment. For example, the following embodiments also are embraced by the invention defined by the claims, and still other changes can be made without departing from the scope and spirit of the invention defined by the claims.

The cover is mounted on a female connector in the foregoing embodiment, but it may be on male connector.

The auxiliary housings are the same in the foregoing embodiment. However, the auxiliary housings may be different from one another.

The cover automatically pushes insufficiently inserted auxiliary housings as the cover is mounted in the foregoing embodiment. However, the divided connector need not automatically push the auxiliary housing if the cover mounting direction is orthogonal to the auxiliary housing inserting direction.

The guide surfaces to correct insufficient insertion are on the auxiliary housing in the foregoing embodiment, but they may be on the latches.

The latches for doubly locking the auxiliary housings are ribs that extend from the ceiling to the front edge of the cover in the foregoing embodiment. These ribs reinforce the cover. However, the latches may only be at the front end if reinforcement is unnecessary.

A lever 60 is the movable member for assisting connection of the female connector F with the male connector M in the foregoing embodiment. However, another movable member can be provided, such as a slider being movable in a linear path, or no movable member may be provided at all.

What is claimed is:

1. A divided connector comprising:

a frame having a mounting surface and at least one accommodating chamber extending into the mounting surface;

at least one auxiliary housing having opposite front and rear ends, the front end of the auxiliary housing being mounted in the accommodating chamber along an inserting direction; and at least one cover slidably mounted to the mounting surface of the frame along an operating direction aligned substantially normal to the inserting direction of the auxiliary housing so that the cover substantially covers the mounting surface, at least one latch formed on the cover and having a front end disposed to move substantially along the rear surface of the auxiliary housing during the slidably mounting of the cover when the auxiliary housing is located properly in the frame, the latch being disposed for interfering with the auxiliary housing when the auxiliary housing is inserted insufficiently in the frame, at least one of the front end of the latch and the rear surface of the auxiliary housing having a guide surface slanted relative to both the operating direction of the cover and the inserting direction of the auxiliary housing and pushing the auxiliary housing to a proper mount position by a moving force of the latch as the cover is mounted slidably to the frame along the operating direction.

2. The divided connector of claim 1, wherein the accommodating chamber has at least one resiliently deformable retaining portion engageable with the auxiliary housing for retaining the auxiliary housings at the proper mount position.

3. The divided connector of claim 1, wherein the cover initially is mounted substantially along the inserting direction of the auxiliary housings towards a position retracted with respect to the operating direction from the proper mount position on the mount surface of the frame, and then is moved on the mounting surface of the frame in the direction intersecting the inserting direction of the auxiliary housings towards the proper mount position.

4. The divided connector of claim 1, wherein the frame has at least one resiliently deformable return stopping protuberance and wherein the cover has an inner surface that moves over and deforms the return stopping protuberance of the frame, the return stopping protuberance being resiliently restored to prevent the cover from returning.

5. The divided connector of claim 1, wherein at least one protrusion is provided in the accommodating chamber for engaging a locking edge of the auxiliary housing to stop the auxiliary housing at an insertion stop position.

* * * * *